United States Patent [19]

Oftelie

[11] 4,270,370

[45] Jun. 2, 1981

[54] RADIO OPERATED LATCH DEAD-BOLTING SYSTEM

[76] Inventor: Phil C. Oftelie, 3215 Golden Blvd., Omaha, Nebr. 68123

[21] Appl. No.: 962,090

[22] Filed: Nov. 20, 1978

[51] Int. Cl.[3] ..... E05B 63/14

[52] U.S. Cl. ..... 70/118; 70/265; 70/282

[58] Field of Search ..... 70/118, 265, 262, 263, 70/266, 277, 282, 283; 312/219, 100–102

[56] References Cited

U.S. PATENT DOCUMENTS

| | | | |
|---|---|---|---|
| 1,152,776 | 9/1915 | Wolfe et al. | 70/118 X |
| 1,670,277 | 5/1928 | Albach | 70/118 |
| 2,153,088 | 4/1939 | Knell | 70/262 X |
| 2,729,089 | 1/1956 | Pelcin | 70/283 X |
| 3,725,939 | 4/1973 | Saltzstein | 70/277 X |
| 3,919,869 | 11/1975 | Fromm | 70/263 |
| 3,953,991 | 5/1976 | Grossman | 70/282 X |
| 3,996,591 | 12/1976 | Hayward | 70/282 X |

*Primary Examiner*—William E. Lyddane

[57] ABSTRACT

A container locking system for vending machines, buildings, vehicles, or other containers comprising a door latch, a primary door lock assembly locking and controlling the latch, and a radio lock assembly comprising a radio transmitter, a radio receiver inside of the container, a solenoid operated when the receiver receives a signal from the transmitter, and a dead-bolt operated by the solenoid and preventing unlatching of the door latch except at times when the solenoid is operated by the transmitter whereby a thief who has a way of opening the door lock without force cannot open the door without noticeable forcible entry.

4 Claims, 6 Drawing Figures

RADIO OPERATED LATCH DEAD-BOLTING SYSTEM

BACKGROUND OF THE INVENTION

At the present time the state of the prior art has been that vending machines have had relatively simple locks, using keys. The industry has not desired to place heavy locks on the machines, since, if they were heavily locked, thieves could break in by damaging the cabinet which is of light sheet metal to a damage extent of approximately two or three hundred dollars.

The industry has preferred to either mount audible alarms or more often to simply allow them to break in since the damaging break-ins are much less frequent than unauthorized lock opening by a person using a key illegally or a lock-picker.

Break-ins of the damaging type involve noise and a chance of getting caught. Thieves have become skillfull at getting lock picking keys and even at getting keys to duplicate the proper keys for a lock.

My solution to this problem is to provide a radio controlled extra lock which can be unlocked by a proper person having a transmittal signal unit.

To open a door, an authorized person needs a transmitting unit and a proper key.

An advantage to the machine owner of a machine having the auxiliary lock of this invention is that the thief does not know that there is an auxiliary device locking the door. He sees only a standard keyhole.

An advantage of my invention is to provide an operator with the ease of only needing to simply close the door, twist the key for locking, and remove the key, without any special manipulation of the transmitter, because the locking of a primary lock will have moved its latch out of a position for holding the radio-lock solenoid dead-bolt in unbolting position so that the dead-bolt moves by its own spring into a position for dead-bolting the latch to keep the latch from moving. In brief, the advantage is that at a time after closing the door, the solenoid dead-bolt need not be reset. It is automatically reset into dead bolting position by the movement of the latch in response to the twisting of the key for locking.

This invention is important for the locking of both doors and gates, and as mounted on containers of many kinds, vending machines, shipping containers, houses, buildings, vehicles, or fenced areas.

SUMMARY OF THE INVENTION

A main goal hereof is to provide a container locking system using both primary lock and radio controlled lock in which the container can be a vending machine, shipping container, house, building, vehicle or even a fenced area forming a container, the system comprising a standard latch moveably mounted on a door or gate of the container and moving into and out of latching relationship with catch means on the door, a primary lock assembly operably correlated with the primary latch and capable of transferring latching and unlatching motions to the primary latch when a primary lock of the primary lock assembly has been unlocked, and a radio lock assembly comprising a radio transmitter outside of the container, a radio receiver inside of the container, a solenoid inside the container, a power source connected to the solenoid and to the radio receiver in a manner such that said solenoid is operated only when said receiver receives a signal from said transmitter, and dead bolt means operably correlated with the solenoid and with the latch so that the dead bolt prevents opening motions of the primary latch except at times when the solenoid is operated indirectly by the transmitter whereby a thief who has a way of opening the primary lock without force cannot gain access to the container without forceable entry which would cause greater liklihood of detection.

DESCRIPTION OF THE PREFERRED EMBODIMENT

Figure 1:
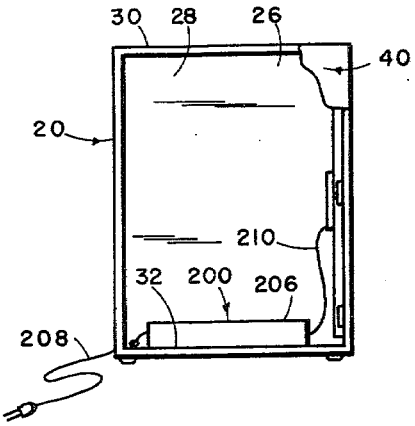
FIG. 1 is a side elevation of the container locking system of this invention, showing a container portion thereof with a closer side removed and showing a transmitter close to the container but not attached to it.

The radio-operated latch dead-bolting system of this invention can also be called a container locking system using both primary lock and radio-controlled lock, and this system is generally indicated at 10 in FIG. 1 and comprises a container generally indicated at 20 having a door jamb 26 which can be considered as formed, in a sense, of portions of right and left sidewalls 28 of the container (only the right sidewall being shown in FIG. 1 since the left sidewall is removed), and forward portions of a top wall 30 and a bottom wall 32 of the container 20.

It is to be understood that the term "container" as used herein can be used to refer to a vending machine for vending items of any kind, a shipping container, a house, a building, a vehicle of any kind, or even a fenced area, in which latter case, one need only imagine the parts described in FIG. 1 as being without the top and bottom walls and perhaps with the other walls perforated as is the case with fenced areas.

In any of these uses, there is a door, such as the door 40 of a vending machine, although the numeral 40 can also represent the perforated gate of a fenced area which could also be considered a door.

Figure 2:
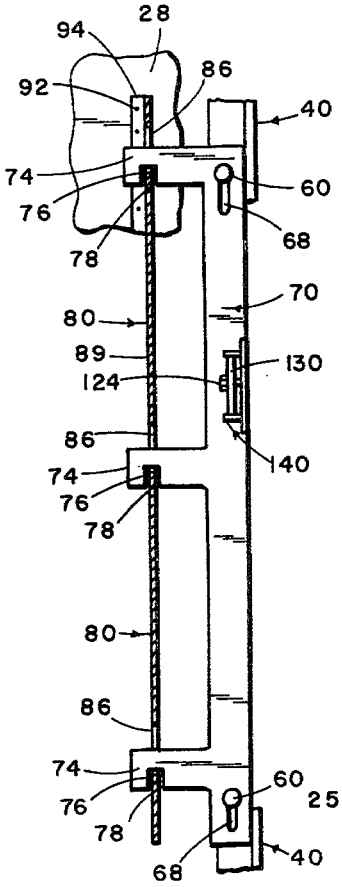
FIG. 2 is a vertically moving latch with multiple hooks received in a catch, the catch being shown with closer portions broken away and the remainder shown in section, only a portion of a flange on the catch which attaches the catch to a side wall of the container, and only a portion of the container are shown, and only portions of a mounting for studs received in slots in the catch are shown and only a portion of the door to which the stud mounting is fixed are shown, the remainder of the door not being shown.

In FIG. 2, a small portion of the door 40 can be seen, although the rest is broken away, and on the inner side of the door, which latter is shown at 44, a latch-mounting 46 is shown secured by suitable bonding means or other means 48 to the rearward side of the door.

The mounting 46 has a flange 52 extending rearwardly from the door and from which a plurality of studs 60 extend, the studs 60 being slidably received through slots 68 in a door latch generally indicated at 70, which latter has a plurality of hooks 74 extending therefrom generally horizontally and rearwardly from the door, each hook 74 having a notch 76 in an underside thereof for receiving those portions 78 of a catch 80 therein, which latter portions 78 are disposed immediately below hook-receiving holes 86 which extend horizontally through the catch 80 and particularly through a flange 89 of the catch 80, which latter extends inwardly of the container from the left sidewall 28 thereof, only a portion of which is shown in FIG. 2.

The flange 89 of the catch 80 is supported by being attached to the sidewall 28 by suitable means, such as welding, at 92 extending through a support flange 94 of the catch 80, which latter is parallel to and disposed against the left sidewall 28 of the container 20.

Figure 4:
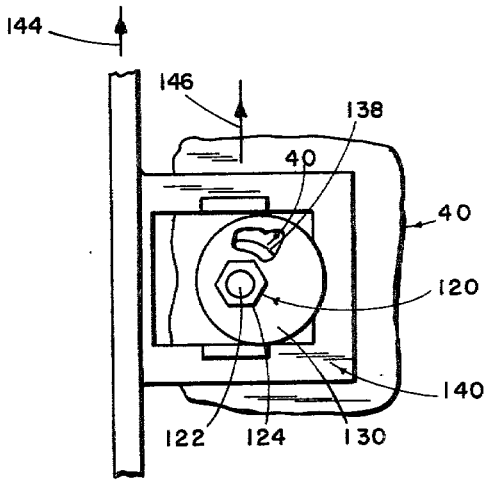
FIG. 4 is a view of a primary lock cam and a cam receiver, shown with the receiver fixed to the latch, most of which is not shown, the cam and cam operating primary lock being shown as mounted on the rearward or innerside of the door, only a portion of the door being shown.

In FIG. 4, a primary lock assembly is generally indicated at 120 and has a shaft 122 extending rearwardly therefrom on which a nut 124 is disposed on the rearward side of a cam 130 for holding the cam 130 on to the shaft 122 in a manner for rotating therewith. A portion of the cam in FIG. 4 is broken away so that a lock body 138 of the primary lock assembly 120 can be seen, even though the lock body 138 is forward of the cam 130 and is suitably fixed to the door 40, only a portion of which is shown in FIG. 4.

A cam receiver generally indicated at 140 is fixed to the latch 70, as seen in FIG. 4, in a manner so that rotation of the shaft 122 will cause rotation of the cam 130 and the receiver is so made that this rotation of the cam 130 will cause the latch 70 and the receiver 140 to move upwardly in the direction of the arrows 144 and 146. This happens when a key is rotated in the lock body 138 in a conventional manner from the forward side of the door, since the lock body 138 is of the kind which provides an open key slot at the forward side of the door, this slot not being shown.

It is understood that many other kinds of lock other than a key lock can be used and that other kinds of ways of causing locking mechanism to raise the latch 70 can be employed. However, in any case, it is to be understood that the primary lock assembly 120 is capable, when operated by human manipulation, of causing the latch 70 to move from a latching position, as shown in FIG. 2 and in FIG. 3, to an unlatching position, as shown in FIG. 5.

Figure 3:
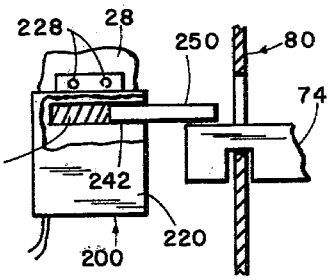
FIG. 3 is a view showing a portion of the innerside of the container of FIG. 1 to which a solenoid housing is fixed, a dead-bolt operated by the solenoid being shown in a position in a position for dead-bolting the latch into latching position, only portions of the latch and catch are shown.
Figure 5:
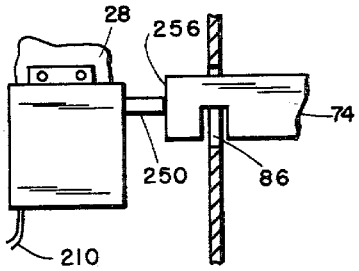
FIG. 5 is a view similar to FIG. 3, but with the dead-bolt in unbolting position with respect to portions of the latch and catch, which latter are shown in unlatching position.

Conversely, rotation of the shaft 122 and cam 130 in the opposite direction will cause the latch 70 to return from unlatching position of FIG. 5 to the latching position of FIGS. 2 and 3.

Referring to FIG. 1, a radio lock assembly is generally indicated at 200 comprising a radio transmitter 204 disposed outside of the container 20, a radio receiver 206 disposed inside the container 20, a power source 208 connected to the housing of the receiver 206, it being understood that the receiver 206 also has in it a switch capable of controlling the delivery of power from a source 208 through an out-wire cord 210 from the receiver 206, which latter leads to a solenoid 220, seen in FIGS. 3 and 5, and which latter is disposed inside of the container 20 and can be mounted on the wall 28, as shown in FIG. 1, by suitable means 228, seen in FIG. 3.

In FIG. 3, a portion of the housing of the solenoid 220 has been broken away to show a trackway 242 in which a dead-bolt 250 is slidably received, the dead-bolt 250 projecting outwardly from the solenoid 220 and being urged into the outer position shown in FIG. 3 by a spring 254 in the inner end of the trackway 242, it being understood that when the solenoid 220 is energized, then the dead-bolt 250 is retracted from the position shown in FIG. 3 to a position as retracted as it is seen in FIG. 5 or more so.

The position of the dead-bolt 250 is such as to engage some part of the latch 70, such as the upper side of one of the hooks 74, in a manner such that when the dead-bolt is an extended position, the latch cannot be unlatched because it cannot move upwardly in the catch 80.

In operation, when an operator approaches the container 20 inserting a key into the lock body 138, he then presses the button 210 of the transmitter 204 at a time when the transmitter 204 is concealed in his pocket and the pressing of the button 210 is not noticeable to a thief who might be watching a vending machine service-man at this time.

The pressing of the button 210 will cause the transmitter 204 to signal the receiver 200, causing delivery of current from the source 208 through the cord 210 to the solenoid 220, causing energizing and retracting of the dead-bolt 250 against the urging of the spring 254.

While the operator keeps his finger on the button 210, he then turns a key in the lock body 138 causing the cam 130 to raise the latch 70 into unlatching position. Then, the operator can release the button 210 and the spring 254 will cause the dead-bolt 250 to reach the position of engagement with an adjacent end portion 256 of a latch hook 74, so that the dead-bolt remains in this position during servicing of the machine.

After the machine has been serviced, the operator then closes the door and twists the key in the lock body 138, rotating the cam 130 into position for moving the latch 70 downwardly into the locked position of FIG. 3 with respect to the catch 80.

The dead-bolt 250 will then immediately pass over the top of the respective hook 74 because of the urging of the spring 254 so that the dead-bolt 250 automatically locks the latch 74 into locking position again.

The spring 254, therefore, causes the dead-bolt to be automatically reset into dead-bolting position without necessity for the operator to do anything more than simply turning the key in the lock body 138.

If the dead-bolt 250 engaged in the door, instead of engaging the latch, then it would cause a concentrated point of resistance to opening the door. On the light sheetmetal doors of vending machines, a thief could bend a lower or upper portion of a door where it would not be held by a dead-bolt extending directly into the door and could gain access by this means rather quickly and quietly. But, by having the dead-bolt have the effect of bolting the latch into position for latching, then the effect is to make use of the latch, also, with its many points of latching at each one of the plurality of hooks 74. This latter has the effect of securing the door at many points, whereby the door cannot be simply bent at a corner in order to gain access. This forces the thief to use substantial forcible entry, a more forceful entry than just quietly bending a corner of the door and, in fact, such an amount of forcible entry as would cause noises to be made that could alarm persons nearby and detectable excessive motions to be made that would look very suspicious even to persons giving the thief only a casual glance.

Figure 6:
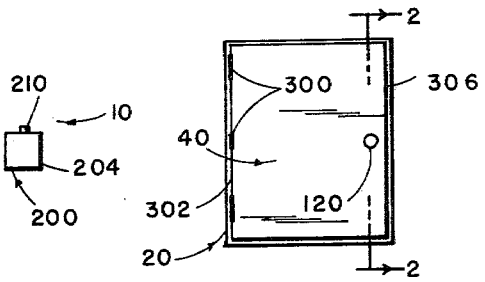
FIG. 6 is a front view of the container as it would be seen from the right-hand side thereof in FIG. 1.

In FIG. 6 it can be seen that the door 40 can be hinged by hinges 300 along one vertical side 302 of the door at vertically spaced places and on the other vertical side of the door 306, the latch 70 is secured to the door 40 at vertically widely spaced points at the studs 60, whereby the upper and lower corners of the door are retained by the latch 70 against being bent outwardly by a thief on the side 306.

I claim:

1. A lock system comprising a vending machine container and a container locking system using both primary lock and radio controlled lock, the system comprising a container having a door jamb, a door moveably mounted in said door jamb, catch means on said door jamb, a primary latch moveably mounted on said door and moving into and out of latching relationship with said catch means on the door, a primary lock assembly having a primary lock mounted on said door, said primary lock assembly being operably correlated with said primary latch and capable of transferring latching and unlatching motions to said primary latch when said primary lock has been unlocked, and a radio lock assembly comprising a radio transmitter outside of said container, a radio receiver inside of said container, a solenoid inside of said container, a power source connected to said solenoid and to said radio receiver in a manner such that said solenoid is operated when said receiver receives a signal from said transmitter, and a dead-bolt operably correlated with said solenoid and with said primary latch so that said dead-bolt prevents unlatching of said primary latch except at times when said solenoid is operated by said transmitter and receiver whereby a thief who has a way of opening said primary lock without force cannot open said door without forceable entry which would cause greater liklihood of detection, said primary lock having a keyhole visible from the outer side of said vending machine container.

2. The lock system of claim 1 having a special construction for providing an operator with the ease of locking said door with said radio-lock assembly by only needing to simply close said door and locking said primary lock without any special manipulation of said transmitter, said special construction comprising a spring urging said deadbolt into bolting position with respect to said latch, said deadbolt being retained in unbolting position against the urging of said spring when said solenoid is not energized by engagement of a portion of said latch with said deadbolt during times when said latch is in unlatching position whereby after closing said door said solenoid deadbolt need not be reset because said deadbolt is automatically reset into deadbolting position by the movement of said latch in response to locking of said primary lock assembly.

3. The lock system of claim 1 in which said latch is movably fixed to said door at a plurality of widely spaced points and in which said latch latches with said catch means at a plurality of widely spaced points.

4. The lock system of claim 3 in which said door has two opposite sides, said door being hinged to the remainder of said container along one of said opposite sides, said spaced places at which said latch is movably secured to said door being spaced along that side of said door which is opposite to said hinged side of said door.

* * * * *